United States Patent [19]

Stibolt

[11] Patent Number: 4,555,867

[45] Date of Patent: Dec. 3, 1985

[54] SECURITY WINDOW COVER

[76] Inventor: Paul E. Stibolt, 22507 Ridgeway Ave., Richton Park, Ill. 60471

[21] Appl. No.: 589,136

[22] Filed: Mar. 13, 1984

[51] Int. Cl.[4] ..... E05B 65/04

[52] U.S. Cl. ..... 49/67; 49/379; 49/402; 49/504

[58] Field of Search ..... 49/67, 379, 56, 381, 49/402, 504; 52/217, 213

[56] References Cited

U.S. PATENT DOCUMENTS

| | | | |
|---|---|---|---|
| 618,145 | 1/1899 | Tremmel | 49/67 X |
| 2,199,590 | 5/1940 | Groth | 52/213 |
| 2,770,335 | 11/1956 | Sylvan | 52/217 X |
| 3,375,627 | 4/1968 | Bursiek et al. | 49/504 X |
| 3,537,212 | 11/1970 | Gilles | 49/402 X |
| 3,561,162 | 2/1971 | Goldman | 49/379 X |
| 3,738,062 | 6/1973 | Ughi | 49/67 X |
| 3,921,334 | 11/1975 | Black, Sr. | 49/56 |
| 3,978,614 | 9/1976 | Goldhaber | 49/55 |
| 4,079,548 | 3/1978 | Zaccaria | 49/67 |
| 4,175,357 | 11/1979 | Goldhaber | 49/67 X |
| 4,258,504 | 3/1981 | Hicks | 49/56 |
| 4,378,658 | 4/1983 | De Lorean | 49/379 |
| 4,489,517 | 12/1984 | Young | 49/504 X |

*Primary Examiner*—Philip C. Kannan

*Attorney, Agent, or Firm*—Charles R. Mattenson

[57] ABSTRACT

An improved security window cover having a peripheral frame structure and a security shielding door or cover hingedly attached to the frame. The frame has walls which conform to the interior building wall adjacent the window and walls which conform to the shape, contour and dimensions of the inner circumferential edge of the wall opening in which the window is installed. The inner circumferential walls of the frame have partial rigid joints joining them to one another which create a degree of flexibility for fit and installation. The shielding door preferably has a lip or ridge on the outside which is medial and parallel to the edges of the door which serves to strengthen the door, protect the frame installation means and act as a guide and support for insulation.

10 Claims, 6 Drawing Figures

FIG. 1
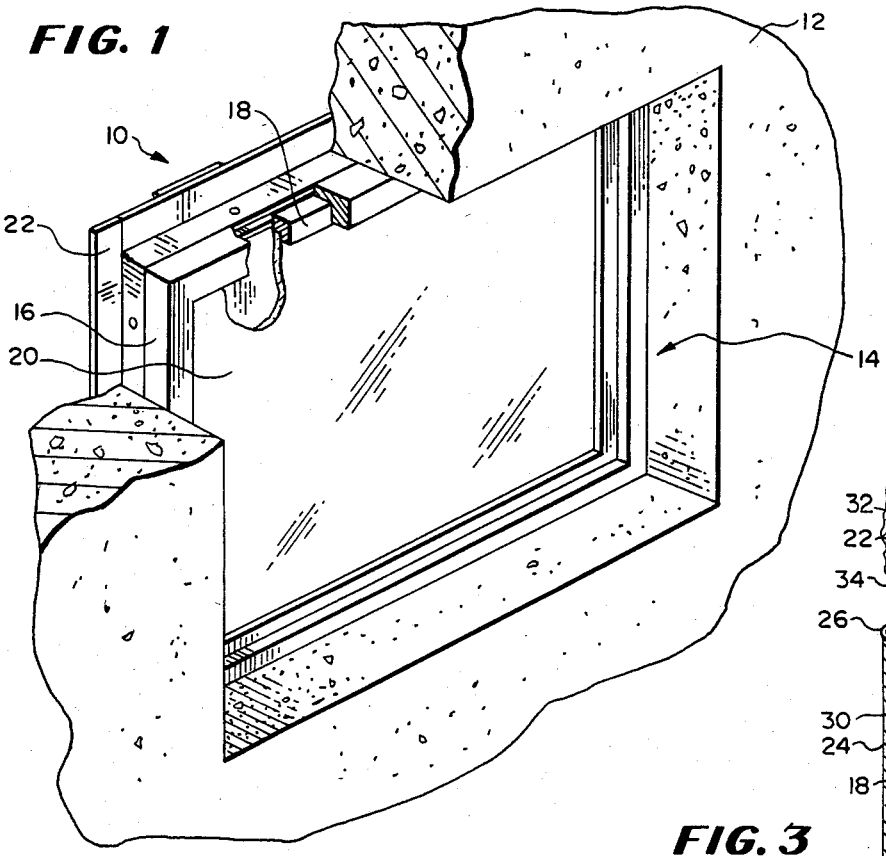
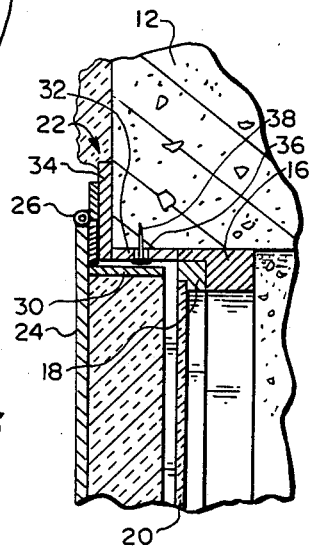
FIG. 3
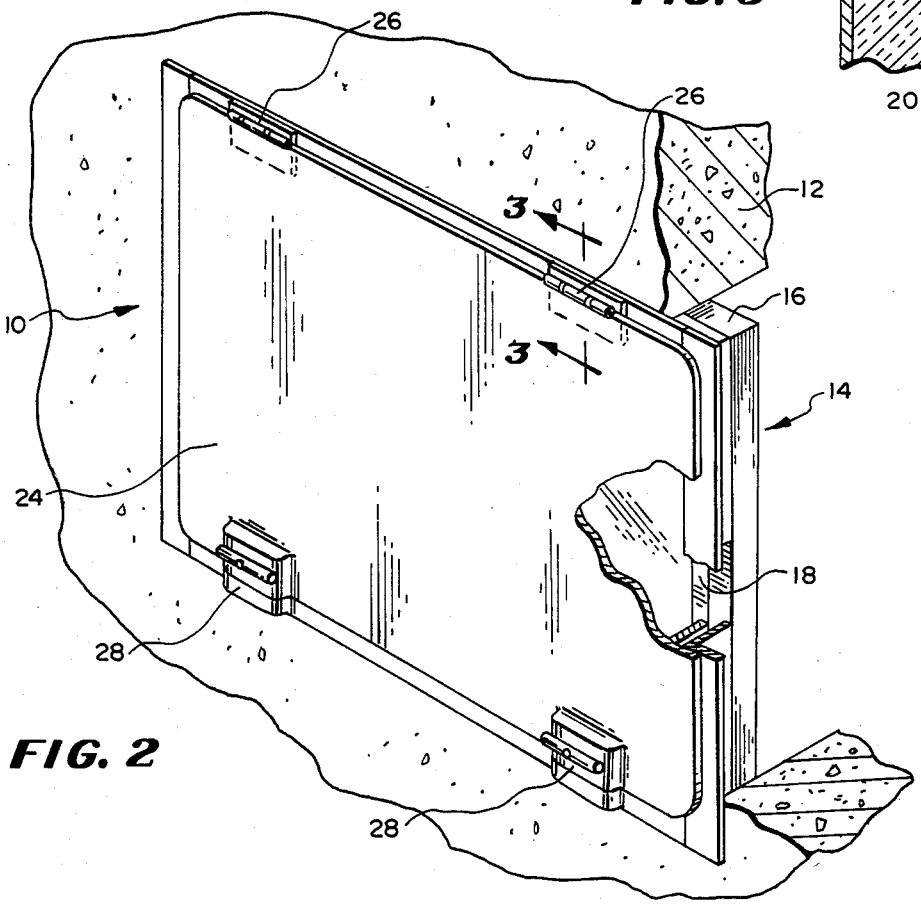
FIG. 2

FIG 5
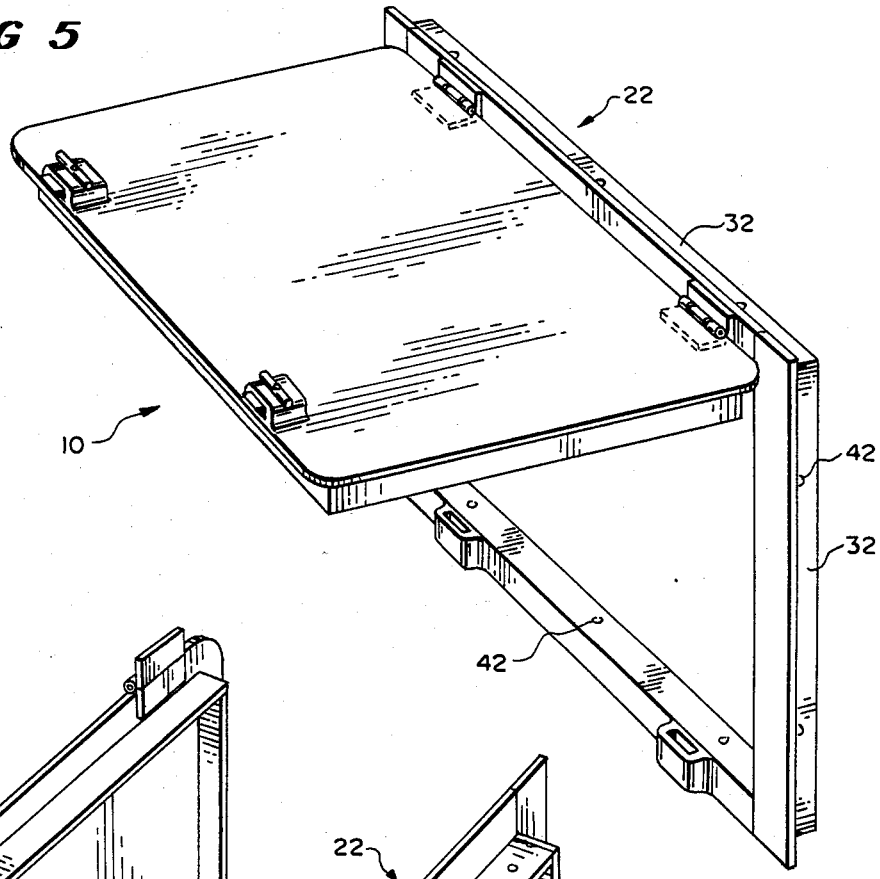
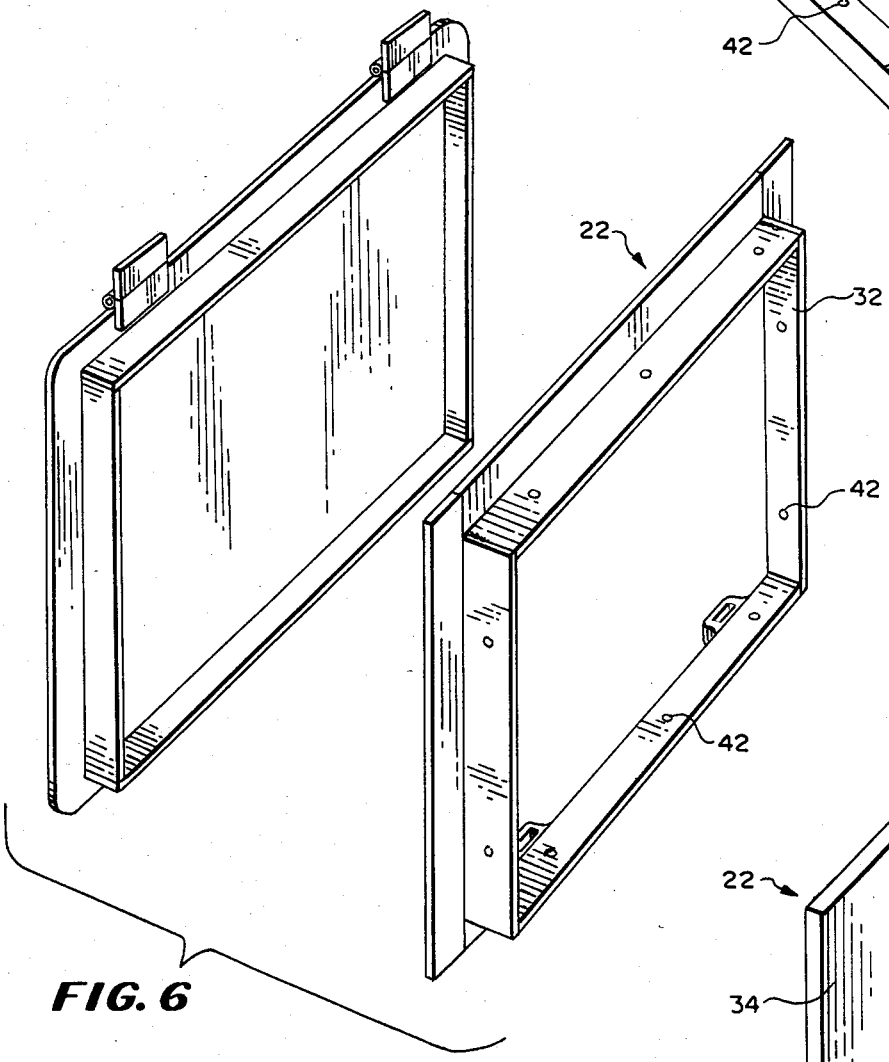
FIG. 6
FIG. 4
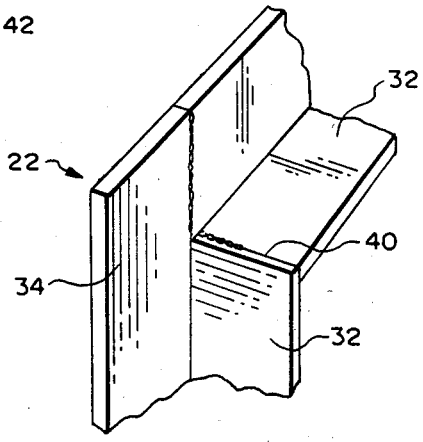

SECURITY WINDOW COVER

BACKGROUND OF THE INVENTION

1. Field of the Invention

The present invention relates to protective enclosures for building openings and, more particularly relates to coverings comprising shatter resistant materials and frames and secured to the building openings in such a manner that they may not be removed or opened from the outside but are easily and readily opened from the inside.

2. Description of the Prior Art

The problem of burglars and other persons attempting illegal entry into buildings and particularly homes is rampant and well known. A number of solutions have been offered for securing building openings against such trespass, although none have been entirely satisfactory.

One prior art method of securing building openings is by employing grate or bars. These suffer in that they severely limit or preclude emergency egress and are generally unslightly. Another prior art solution is to use glass block. However, the permanent nature of a glass block installation creates certain disadvantages such as lack of air circulation, no possibility of emergency ingress or egress, etc.

One of the most common points of illegal entry in homes is the foundation window. These windows are often below ground level in window wells making them readily accessible to burglars and others seeking unauthorized entry. One common treatment employed for such windows is a grate over the window well. However, these are often removable from the outside which seriously impairs their value for security purposes. Furthermore, such grates are generally used to keep leaves and twigs etc. from accumulating in the wheel well as well as for preventing small children from falling into the well.

Another prior art solution to the problem is a lid or cover over the window well which locks down from the inside. Such a lid is also not very satisfactory because it precludes air circulation and also seriously impairs drainage around the house. Window wells are often employed as a major drain point for moisture around the house and include a vertical drain in the center of the well. Such a lid would preclude this use and render totally useless the drain in the well.

The glass block alluded to above is occasionally used for foundation windows. However, in addition to the disadvantages noted above, such a foundation window treatment also cuts off what is often the only means through which materials for major repairs can be brought into the house. For example, foundation windows are often used to bring in long lengths of pipe for major plumbing repairs which could not otherwise be brought into the house through existing doors, hallways etc.

The present security window cover of the invention provides a high degree of security, ease of operation and simple egress in the case of emergency. It also minimizes hindrance to the free circulation of outside light and air and is efficient in terms of energy conservation. The security window cover is mounted on the inside of the building opening, for example the inside of a foundation wall, in such a way that when open it does not hinder normal foundation window operation and when unlocked it automatically swings up and is maintained out of the way. When closed the cover is automatically locked from the inside and is easily provided with insulation, weather-stripping, etc. to insulate what is otherwise commonly an area of very high energy loss. Also, the security window cover of the present invention can be readily covered, laminated or painted on the inside to match existing wall treatments and therefore not be an unsightly addition to a room.

SUMMARY OF THE INVENTION

In accordance with the present invention, an improved security window cover is provided. The window cover provides a high degree of security, ease of operation and energy conservation and is especially useful for securing foundation windows and casement windows. The cover includes a peripheral frame structure conformed to the shape of the window to be secured and a security shielding door or cover hingedly attached to the frame. The door shields the window and is hingedly attached to the frame structure on the interior side of the window. The frame preferably has at least one wall intended to conform to the interior building wall adjacent the wall opening in which the window is installed. The frame also includes another wall intended to ultimately be conformed to the shape, contour and dimensions of the inner circumferential edge of the wall opening in which the window is installed. The frame can be L-shaped in cross-section with a first wall which extends substantially perpendicular to the door when the door is in the closed position and a second wall substantially perpendicular to the first wall and parallel to the door when the door is closed.

In one embodiment of the invention, the first perpendicular walls of the frame structure are provided with slots between the ends of the first walls along a portion of their end transverse dimension on the side thereof furthest from the parallel wall. This particular feature provides significant advantages in fitting and installing the security window cover over the existing window. The slots create a degree of flexibility which allows the installer to quickly and easily bend or shape the perpendicular walls to adjust the dimensions between the respective first perpendicular walls to fit a particular foundation window to be secured. This is particularly important when installing the invention long after construction of the building when the dimensions of the opening to be secured have often shifted or become non-standard due to weathered or worn materials, shifting and/or cracking foundations, etc.

In one embodiment, the door or cover has a lip or ridge which is medial and parallel to the edges of the door and on the side of the door facing the outside of the building when the door is in the closed position. This ridge serves to strengthen the security door. When the door is in the closed position, the ridge also serves to protect the means employed to fasten the peripheral frame structure to the foundation. In addition, the ridge acts as a guide and support for insulation which may be added to the outside of the door for energy conservation purposes.

In accordance with one embodiment, the security window cover is designed such that, in addition to the above noted advantages over the prior art, if unlocked the door is open and if closed it is always locked. When opened, the door also opens up automatically and is self-supporting. Beside the convenience added by such a configuration, it is far safer in the event of fire or other emergency because it provides easier ingress and egress.

Moreover, as high strength spring latches are preferably employed, it is impossible to close the security cover and forget to lock it. Also, because the security door preferably opens in an upward direction it also minimizes any obstruction to window operation or to light entering a room.

The entire assembly is designed to be mounted on the inside of the building directly to the foundation. The frame preferably has spaced indentations which aid installation with devices such as a power nailer or which can act as drill guides for matching holes to be drilled in the peripheral frame and the foundation. Appropriate anchors, such as grip pin expansion anchors, are then set through the watching holes in the foundation. Installation can be easily, quickly and securely achieved by skilled or relatively unskilled personnel.

In accordance with another aspect of the invention, there is provided a method of adjusting the fit of the security window cover to the building opening and window to be secured. The method includes adjusting the perpendicular walls to more closely conform to the shape, contour and dimensions of the building opening and window to be secured. This is accomplished in the preferred embodiment by employing spaced apart slots in the perpendicular walls of the frame structure which allow for adjustment and deformation of the perpendicular walls to make them more closely correspond to the desired shape, contour and dimensions for each particular installation application.

BRIEF DESCRIPTION OF THE DRAWINGS

The invention can be more completely understood by reference to the accompanying drawings in which:

FIG. 1 is a partially broken away perspective view from outside the building of a security foundation window cover of the present invention installed over the inside of an existing foundation window;

FIG. 2 is a partially broken away perspective view from inside the building of the assembly of FIG. 1;

FIG. 3 is a partial cross-sectional view along line 3—3 of FIG. 2;

FIG. 4 is a partial perspective view of the construction of one corner of the peripheral frame member of the instant invention;

FIG. 5 is a perspective view of the security foundation window cover of the instant invention in the open position; and FIG. 6 is a partially exploded perspective view of the security foundation window cover of the instant invention.

DESCRIPTION OF THE PREFERRED EMBODIMENTS

Referring now more particularly to FIG. 1, there is illustrated a partially broken away, perspective view of a security window cover 10 of the present invention. Security window cover 10 is installed over a previously installed foundation window 14 of concrete foundation 12 which forms part of a building. Foundation window 14 illustrated in FIG. 1 is a casement-type window having an outer sash 16, and an inner sash 18 which encloses a glass pane 20 of window 14 and wherein inner sash 18 with glass pane 20 is hingedly attached, generally at the bottom, to outer sash 16 so that window 14 can be opened by swinging inner sash 18 from the top towards the inside of the building. As can be seen in FIG. 1, a peripheral frame structure 22 of security window cover 10 is mounted in accordance with the instant invention on foundation 12 immediately interior to and abutting outer sash 16 of foundation window 14.

The frame preferably has at least one wall intended to conform to the interior building wall adjacent the wall opening in which the window is installed. The frame also includes another wall intended to ultimately be conformed to the shape, contour and dimensions of the inner circumferential edge of the wall opening in which the window is installed. The frame can be L-shaped in cross-section with a first wall which extends substantially perpendicular to the door when the door is in the closed position and a second wall substantially perpendicular to the first wall and parallel to the door when the door is closed. Such a configuration might be formed, for example, by welding two pieces of bar stock together longitudinally at an appropriate angle to one another or bending a single piece along an appropriate longitudinal axis.

FIG. 2 is a partially broken away, perspective view of security window cover 10 taken from inside of foundation 12. In addition to the elements shown in FIG. 1, for which like reference numerals are employed, one can more clearly see the preferred embodiment of the instant invention wherein a security shielding door or cover 24 is hingedly attached to peripheral frame structure 22 by hinges 26.

It should be noted that while hinges 26 are illustrated in this embodiment as a flat-type hinge, other types of hinges, including continuous hinges, may be employed without departing from the spirit of the present invention. Preferably, hinges 26 comprise a spring-type hinge mechanism including a preset or adjustable stop therein. Such a hinging mechanism serves not only as an aid to open the security cover, but would also serve to automatically open the security cover when unlocked to an upper position and support the cover in that position. This particular feature adds a number of advantages over prior art devices not the least of which is easier and faster opening and therefore egress from inside the building in case of emergency. This embodiment of hinges 26 also serves to maintain security cover 24 up and out of the way when not in the closed position and avoids any possible hindrance to the normal operation of foundation window 14 and also avoids any hindrance to normal light transmission through foundation window 14.

Security door 24 is preferably fabricated from a material which is strong enough to withstand substantial manual force applied from outside the foundation window, such as steel or fiberglass. Door 24 may alternatively be fashioned of steel with translucent or transparent inserts for light transmission or any other suitable material. Also, the configuration of door 24 also readily lends itself to being covered, laminated or painted to match or otherwise blend well with existing wall treatments and therefore reduce significantly the otherwise generally unsightly nature of most prior art configurations.

FIG. 2 also illustrates one embodiment of a locking mechanism 28 which may be employed with security foundation window cover 10. Two locking mechanisms 28 are shown for illustrative purposes only. A number of different locking mechanisms, all well known in the art, as well as a different number of locking mechanisms, may be substituted without departing from the spirit of the instant invention. However, whatever locking mechanism is employed, it should be strong enough to withstand the application of substantial manual force from outside the building and preferably be of a spring locking type so that the security foundation window cover of the instant invention cannot be closed and inadvertently left unlocked.

It should be noted that the combination of the latter two features of the instant invention, specifically spring-type hinges 26 and spring-type locking mechanisms 28, creates a particularly advantageous improvement over the prior art. Specifically, with this particular combination of features, security window cover 10 is automatically locked when closed and is automatically opened and supported up and out of the way of emergency ingress and egress when unlocked. Also, there is no hindrance to foundation window operation and therefore no hindrance to the entry of light and fresh air.

FIG. 3 is a partial, cross-sectional view along line 3—3 of FIG. 2 and more clearly illustrates the alignment and relative positions of the major structural portions of security window cover 10 and foundation window 14. As can be seen, peripheral frame structure 22 is substantially L-shaped in cross-section, including a wall 32 which is substantially perpendicular to security door 24 when door 24 is in the closed position and a wall 34 which is substantially parallel to door 24 when door 24 is closed. Each perpendicular wall 32 of frame 22 fits closely against the corresponding portion of outer sash 16 of foundation window 14. This particular configuration and fit of peripheral frame 22 allows foundation window 14 to be operated normally when door 24 is in the open, up position.

FIG. 3 also illustrates a preferred embodiment in which security door 24 has a ridge 30 on the side thereof facing the outside of the building when door 24 is in the closed position. Ridge 30 is preferably continuous and located medial and substantially parallel to the edges of door 24. The inclusion of ridge 30 in the instant invention also provides multiple advantages over prior art configurations. First, as illustrated in FIG. 3, ridge 30 is preferably positioned on security door 24 such that when cover 24 is in the closed position ridge 30 covers over and therefore protects from external tampering points 36 at which peripheral frame structure 22 is secured to foundation 12. Frame 22 may be secured to foundation 12 by any one of a number of well known means including but not limited to grip expansion anchors 38 or by the use of a power nailer. Ridge 30 also serves to strengthen door 24 as well as act as a guide and support for insulation material which might optionally be added to the outside of door 24 for energy conservation purposes such as in shown in FIG. 3.

It should be noted that the security window cover of the present invention can and preferably should be fitted with further insulating and energy conserving features. For example, a continuous bead of silicone or other appropriate material can be applied to frame 22 along the juncture of walls 32 and 34 on the outside of the frame to effectively block heat escaping and cold air leaking in. Also, an appropriate form of weather-stripping should be applied to the inside of door 24 on the same side as and around the perimeter of ridge 30. This weather-stripping serves not only to much more effectively seal around ridge 30 for energy conservation, but also serves to effectively minimize noise which might be attendant in for example closing a steel door on a steel frame.

Referring now more particularly to FIG. 4, there is illustrated a partial perspective view of one corner of peripheral frame structure 22, including a very important feature of the preferred embodiment of the present invention. As shown in FIG. 4, perpendicular walls 32 of frame 22 are rigidly connected to one another at their ends to form slot preferably by a weld, from the edge which is closest to walls 34 to point only partially along the contact surfaces of the respective walls 32 to form slot 40 which is located between the unconnected portions of the ends of the respective walls 32. This feature, the partial securing of respective walls 32 to one another, is particularly important in achieving the required close fit of peripheral frame 22 to foundation wall 12 and outer sash 16 of foundation window 14 as illustrated and discussed with respect to FIG. 3. This slot 40 allows perpendicular walls 32 to be contoured, spread or bent slightly at installation to achieve a closer fit between peripheral frame 22, foundation 12 and outer sash 16 of foundation window 14. This capability is particularly important when installing security window cover 10 in a foundation which was built and over a window which was installed some years earlier. It is quite common for the dimensions of the foundation opening, and also the foundation window installed therein, to have shifted or become non-standard over time due to weathered or worn materials, shifting and/or cracking of the foundation, etc. By not securing perpendicular walls 32 to one another along their entire end dimension, a degree of flexibility is maintained which allows the installer to quickly and easily adjust the dimensions between respective perpendicular walls 32 to fit a particular foundation window to be secured.

It should be noted that the present invention is by no means limited to the rectangular configuration illustrated. The security window cover of the present invention can just as well be adapted to building openings having any other shape including but not limited to octagons, parallelograms and even circles. In the case of a circular building opening, the security window cover would also be circular with a circular frame structure, circular security door, etc. In such a case, the flexibility achieved by employing slots would still be present. However, in such an embodiment perpendicular wall 32 would preferably comprise a single piece in a circular shape with slot 38 inserted therein, such as by cutting. Such a circular wall 32 might also be fabricated from a plurality of individual pieces rigidly joined to one another along a portion of their end dimensions, as by welding, to form slots.

FIGS. 5 and 6 illustrate respectively a perspective and a partially exploded view of security window cover 10. In addition to the components discussed above with respect to FIGS. 1 through 4, FIGS. 5 and 6 more clearly show that walls 32 of peripheral frame structure 22 are preferably supplied with spaced indentations 42 on all sides. Indentations 42 serve to aid in the installation of security window cover 10 by acting as points of attachment 36 shown in FIG. 3. They may act as guides for spacing to be used by a contractor who might be installing the device with a power nailer. Indentations 42 can also act as a drill guide for the individual home owner who might be installing window cover 10 himself by drilling corresponding holes in wall 32 and foundation 12 and subsequently anchoring frame 22 to the foundation 12 with devices such as grip pin expansion anchors 38 shown in FIG. 3 or others well known in the art.

Modifications and variations may be made in the instant invention without departing from the spirit or essence of the invention. For example, a hinge-type mechanism which attaches to the side pieces of peripheral frame 22 may be employed to open and support security door 24. Door 24 and ridge 30 could be of cast or welded construction. Peripheral frame 22 with walls 32 and 34 could also be of cast or welded construction.

In view of the discussion above, what is described and claimed to be secured by Letters Patent of the United States is:

1. A security window cover comprising:

a peripheral frame structure circumscribing a window, said frame being adapted to abut the opening in which the window is secured;

a security shielding door, said door being hingedly attached to said peripheral frame such that when in the closed position the combination of said door and said peripheral frame member completely covers said opening, said shielding door including a rdige located medial and substantially parallel to the edges of said door, said ridge serving to strengthen said door, act as a guide and support for insulating material which may be added to the outside of said door for energy conservation and provide protection for said frame from tampering from outside said window;

locking means on the inside of said security window door for securing said shielding door to said frame when said door is in the closed position;

the shape of said peripheral frame structure and said frame being substantially that of a parallelogram and having at least one first wall for conforming to the interior building wall adjacent said window and at least four second walls for conforming to the inside circumference of said window, said second walls having partial rigid joints securing said four walls to one another at the corners of said parallelogram along only a portion of the end dimension of each said second wall to allow for a final adjustment in fit when being installed over a window.

2. The security window cover defined in claim 1 wherein said shielding door is hingedly fixed to said peripheral frame by hinge means along the inner portion of one side of said peripheral frame, said hinge means supporting said shielding door in a normally open and up position for easier egress from inside the building in case of emergency and to minimize any hindrance to either the normal operation of said window or light entering the building through said window.

3. The security window cover defined in claim 2 wherein said hinge means comprises a spring-type hinge mechanism for automatically raising said shielding door to an upward and open position when said locking means is released and for supporting said shielding door in said upward position.

4. The security window cover defined in claim 1 wherein said second walls of said peripheral frame have spaced indentations which act as guides and aids for anchoring said security window cover to a building opening, said indentations being positioned such that they are covered by said ridge when said shielding door is in the closed position.

5. The security window cover defined in claim 1 wherein said locking means lock said shielding cover automatically when said shielding door is closed so that said security window cover cannot be closed and inadvertently left unlocked.

6. The security window cover defined in claim 1 further comprising means for securing said frame structure to said opening in which said window is secured.

7. The security window cover defined in claim 6 wherein said securing means includes spaced indentations in said at least one second wall to facilitate installation by acting as a tool guide.

8. The security window cover defined in claim 7 wherein said at least one second wall is dimensioned to fit into said opening adjacent the sash of said window.

9. The security window cover defined in claim 1 further comprising insulating material mounted on the outside of said shielding door and supported by said ridge to provide substantially increased energy conservation.

10. The security window cover defined in claim 9 further comprising insulating means around the outer perimeter of said ridge on said shielding door and around said frame on the side thereof adapted to abut said building opening for increased energy conservation.

* * * * *